US010935044B2

(12) United States Patent
Ottow et al.

(10) Patent No.: US 10,935,044 B2
(45) **Date of Patent: *Mar. 2, 2021**

(54) SEGREGATED IMPELLER SHROUD FOR CLEARANCE CONTROL IN A CENTRIFUGAL COMPRESSOR

(71) Applicant: Rolls-Royce Corporation, Indianapolis, IN (US)

(72) Inventors: Nathan Ottow, Indianapolis, IN (US); Johnathan Acker, Westfield, IN (US); Nate Cooper, Avon, IN (US); Mark Whitlock, Zionsville, IN (US); Michael Nesteroff, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 33 days.

This patent is subject to a terminal disclaimer.

(21) Appl. No.: 16/529,404

(22) Filed: Aug. 1, 2019

(65) Prior Publication Data

US 2019/0353180 A1 Nov. 21, 2019

Related U.S. Application Data

(63) Continuation of application No. 15/165,728, filed on May 26, 2016, now Pat. No. 10,408,226.

(51) Int. Cl.

| | |
|---|---|
| ***F04D 29/42*** | (2006.01) |
| ***F04D 29/16*** | (2006.01) |
| ***F04D 27/02*** | (2006.01) |
| ***F01D 11/22*** | (2006.01) |
| *F04D 29/62* | (2006.01) |

(Continued)

(52) U.S. Cl.

CPC ..... *F04D 29/4206* (2013.01); *F01D 11/22* (2013.01); *F04D 27/0246* (2013.01); *F04D 29/162* (2013.01); *F01D 11/08* (2013.01); *F01D 25/24* (2013.01); *F04D 29/622* (2013.01); *F05D 2220/3219* (2013.01); *F05D 2240/11* (2013.01); *F05D 2250/281* (2013.01); *F05D 2260/57* (2013.01); *F05D 2270/305* (2013.01); *F05D 2270/3013* (2013.01)

(58) Field of Classification Search

CPC ..... F01D 11/22; F01D 11/24; F01D 11/20; F01D 11/14; F04D 29/162; F04D 29/622; F04D 29/284; F04D 29/4206; F04D 29/68; F04D 29/681; F04D 27/0246

See application file for complete search history.

(56) References Cited

U.S. PATENT DOCUMENTS 3,085,398 A * 4/1963 Ingleson ..... F01D 11/22 415/127

5,263,816 A * 11/1993 Weimer ..... F16C 39/06 415/131

(Continued)

*Primary Examiner* — Brian P Wolcott

*Assistant Examiner* — Behmoush Haghighian

(74) *Attorney, Agent, or Firm* — Barnes & Thornburg LLP

(57) ABSTRACT

A system for controlling the clearance distance between an impeller blade tip of a centrifugal compressor and a radially inner surface of a segregated impeller shroud in a turbine engine. The system comprises a driving mechanism coupled to a portion of a segregated impeller shroud. The driving mechanism comprises a driving arm and threaded axial member configured to translate motion of an actuator ring into axially forward and aft motion of the portion of the segregated impeller shroud.

19 Claims, 6 Drawing Sheets

(51) Int. Cl.
*F01D 25/24* (2006.01)
*F01D 11/08* (2006.01)

(56) References Cited

U.S. PATENT DOCUMENTS

| | | | | |
|---|---|---|---|---|
| 6,273,671 | B1 * | 8/2001 | Ress, Jr. | F01D 5/043 415/1 |
| 7,824,151 | B2 * | 11/2010 | Schwarz | F01D 11/22 415/131 |
| 8,087,880 | B2 * | 1/2012 | Karafillis | F01D 11/22 415/118 |
| 8,105,012 | B2 * | 1/2012 | Anema | F04D 27/0215 415/108 |
| 9,121,302 | B2 * | 9/2015 | Duong | F01D 11/22 |
| 9,587,507 | B2 * | 3/2017 | Ottow | F01D 11/22 |
| 2017/0198709 | A1 * | 7/2017 | Moniz | F02C 9/16 |
| 2017/0234147 | A1 * | 8/2017 | Moniz | F01D 5/048 415/173.1 |

* cited by examiner

SEGREGATED IMPELLER SHROUD FOR CLEARANCE CONTROL IN A CENTRIFUGAL COMPRESSOR

CROSS REFERENCE TO RELATED APPLICATIONS

This application is a continuation application of and claims priority to U.S. patent application Ser. No. 15/165,728, filed May 26, 2016, issued as U.S. Pat. No. , the entirety of which is hereby incorporated by reference.

FIELD OF THE DISCLOSURE

The present invention relates generally to turbine engines having centrifugal compressors and, more specifically, to control of clearances between an impeller and a shroud of a centrifugal compressor.

BACKGROUND

Centrifugal compressors are used in turbine machines such as gas turbine engines to provide high pressure working fluid to a combustor. In some turbine machines, centrifugal compressors are used as the final stage in a multi-stage high-pressure gas generator.

FIG. 1 is a schematic and sectional view of a centrifugal compressor system 100 in a gas turbine engine. One of a plurality of centrifugal compressor blades 112 is illustrated. As blade 112 rotates, it receives working fluid at a first pressure and ejects working fluid at a second pressure which is higher than first pressure. The radially-outward surface of each of the plurality of compressor blades 112 comprises a compressor blade tip 113.

An annular shroud 120 encases the plurality of blades 112 of the impeller. The gap between a radially inner surface 122 of shroud 120 and the impeller blade tips 113 is the blade tip clearance 140 or clearance gap. Shroud 120 may be coupled to a portion of the engine casing 131 directly or via a first mounting flange 133 and second mounting flange 135.

Gas turbine engines having centrifugal compressor systems 100 such as that illustrated in FIG. 1 typically have a blade tip clearance 140 between the blade tips 113 and the shroud 120 set such that a rub between the blade tips 113 and the shroud 120 will not occur at the operating conditions that cause the highest clearance closure. A rub is any impingement of the blade tips 113 on the shroud 120. However, setting the blade tip clearance 140 to avoid blade 112 impingement on the shroud 120 during the highest clearance closure transient may result in a less efficient centrifugal compressor because working fluid is able to flow between the blades 112 and shroud 120 thus bypassing the blades 112. This working fluid constitutes leakage. In the centrifugal compressor system 100 of FIG. 1, blade tip clearances 140 cannot be adjusted because shroud 120 is rigidly mounted to the engine casing 131.

It is known in the art to dynamically change blade tip clearance 140 to reduce leakage of a working fluid around the blade tips 113. Several actuation systems for adjusting blade tip clearance 140 during engine operation have been developed. These systems often include complicated linkages, contribute significant weight, and/or require a significant amount of power to operate. Thus, there continues to be a demand for advancements in blade clearance technology to minimize blade tip clearance 140 while avoiding rubs.

The present application discloses one or more of the features recited in the appended claims and/or the following features which, alone or in any combination, may comprise patentable subject matter.

SUMMARY

According to an aspect of the present disclosure, a compressor shroud assembly in a turbine engine having a dynamically moveable impeller shroud for encasing a rotatable centrifugal compressor and maintaining a clearance gap between the shroud and the rotatable centrifugal compressor, said assembly comprises: a static compressor casing; an actuator carried by said casing, said actuator comprising a driving member extending along a radius of and being rotatable about the axis of rotation of the rotatable centrifugal compressor, and a driving mechanism coupled to said driving member to rotate said driving member about the axis of rotation when said actuator is activated; and an impeller shroud carried by said casing, said shroud being threadably coupled to said driving member so that rotation of said driving member about the axis of rotation of the rotatable centrifugal compressor effects translation of at least a portion of said shroud relative to the rotatable centrifugal compressor in an axial direction while maintaining a radial alignment of said portion of said shroud.

In some embodiments the threaded coupling between said driving member and said shroud comprises driving threads which rotate with said driving member while maintaining an axial alignment, and driven threads which translate axially with said portion of said shroud, and wherein said shroud forms a slidable coupling with said casing at a forward end thereof. In some embodiments the actuator comprises two or more driving members spaced around the axis of rotation of said driving members. In some embodiments the shroud assembly further comprises an actuating ring coupled to each of said driving members and to said driving mechanism. In some embodiments the shroud comprises a static inducer portion statically coupled to said casing, and an axially translatable exducer portion threadably coupled to said inducer portion and statically coupled to said driving member, the threaded coupling between said inducer portion and said exducer portion comprising static threads which maintain an axial alignment and moveable threads which rotate and axially translate with said driving member and said exducer portion to effect translation of said exducer portion relative to the rotatable centrifugal compressor in an axial direction. In some embodiments the actuator comprises two or more driving members spaced around the axis of rotation of said driving members. In some embodiments the shroud assembly further comprises an actuating ring coupled to each of said driving members and to said driving mechanism. In some embodiments the shroud assembly further comprises one or more sensors for measuring the clearance gap between said axially translatable portion of said shroud and the rotatable centrifugal compressor, said actuator being activated in response to the clearance gap measured by the one or more sensors. In some embodiments the shroud assembly further comprises one or more sensors for measuring discharge pressure of the rotatable centrifugal compressor, said actuator being activated in response to the measured pressure. In some embodiments the exducer portion comprises a first exducer portion threadably coupled to a second exducer portion, each of said exducer portions being axially translatable.

According to another aspect of the present disclosure, a compressor shroud assembly in a turbine engine having a dynamically moveable impeller shroud for encasing a rotatable centrifugal compressor and maintaining a clearance gap between the shroud and the rotatable centrifugal compressor, said assembly comprises: a static compressor casing; an actuator carried by said casing; an impeller shroud comprising an inducer portion mounted to said casing; and an exducer portion coupled to said inducer portion and said actuator, said actuator being operable to effect translation of said exducer portion relative to the rotatable centrifugal compressor in an axial direction while maintaining a radial alignment.

In some embodiments the shroud assembly further comprises a threaded coupling between said inducer portion and said exducer portion wherein relative rotation about the axis of the compressor between said inducer portion and said exducer portion effects axial translation of said exducer portion. In some embodiments the shroud assembly further comprises a threaded coupling between said exducer portion and said actuator, wherein relative rotation about the axis of the compressor between said exducer portion and said actuator effects axial translation of said exducer portion.

According to another aspect of the present disclosure, a method of dynamically changing a clearance gap between a rotatable centrifugal compressor and an impeller shroud encasing the rotatable centrifugal compressor, said method comprises: coupling an actuator to a static casing; coupling an impeller shroud to the actuator by a threaded coupling; and rotating the actuator about the rotation axis of the compressor to thereby effect translation of at least a portion of the shroud relative to the rotatable centrifugal compressor in an axial direction.

In some embodiments the method further comprises rotating the actuator relative to a portion of the shroud to effect axial translation of a the portion of the shroud while maintaining the axial alignment of the actuator. In some embodiments the method further comprises rotating the actuator relative to a first portion of the shroud to effect axial translation of a second portion of the shroud while maintaining an axial alignment of the first portion of the shroud. In some embodiments the method further comprises activating the actuator responsive to sensing a clearance gap between the shroud and the compressor. In some embodiments the method further comprises activating the actuator responsive to sensing discharge pressure of the rotatable centrifugal compressor. In some embodiments the clearance gap is sensed by more than one clearance gap sensor positioned along the length of the shroud. In some embodiments the discharge pressure is sensed by a pressure sensor in fluid communication with a discharge plenum of the centrifugal compressor.

BRIEF DESCRIPTION OF THE DRAWINGS

The following will be apparent from elements of the figures, which are provided for illustrative purposes and are not necessarily to scale.

Figure 1:
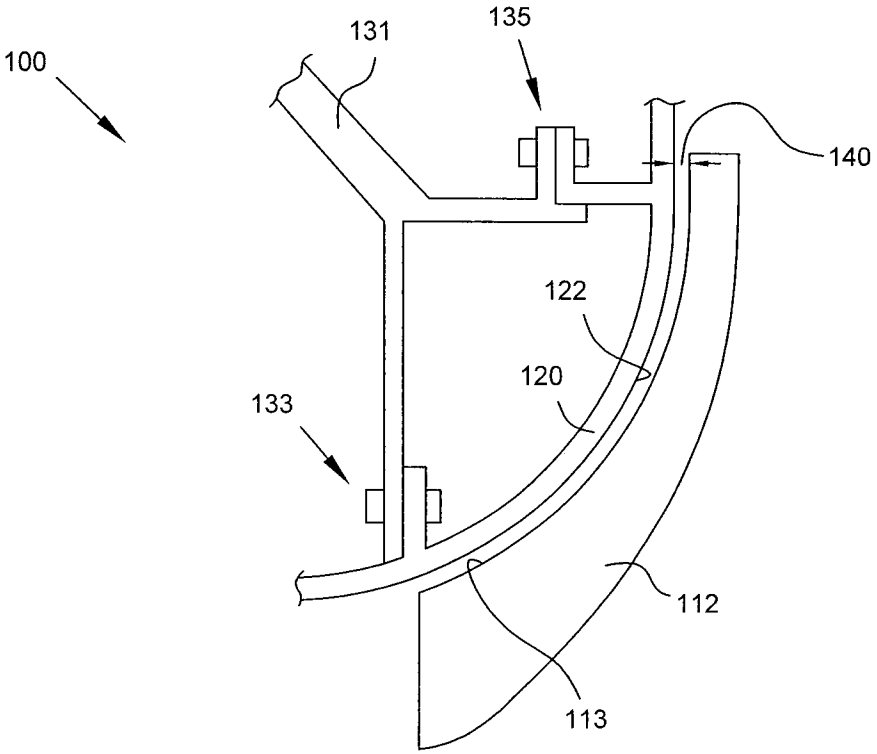
FIG 1 Prior Art
FIG. 1 is a schematic and sectional view of a centrifugal compressor system in a gas turbine engine.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments illustrated in the drawings and specific language will be used to describe the same.

This disclosure presents embodiments to overcome the aforementioned deficiencies in clearance control systems and methods. More specifically, the present disclosure is directed to a system for clearance control of blade tip clearance which avoids the complicated linkages, significant weight penalties, and/or significant power requirements of prior art systems. The present disclosure is directed to a system which translates a pivoting motion of a driving mechanism into axial motion of a segregated, exducer shroud portion to control clearance in a centrifugal compressor.

Figure 2A:
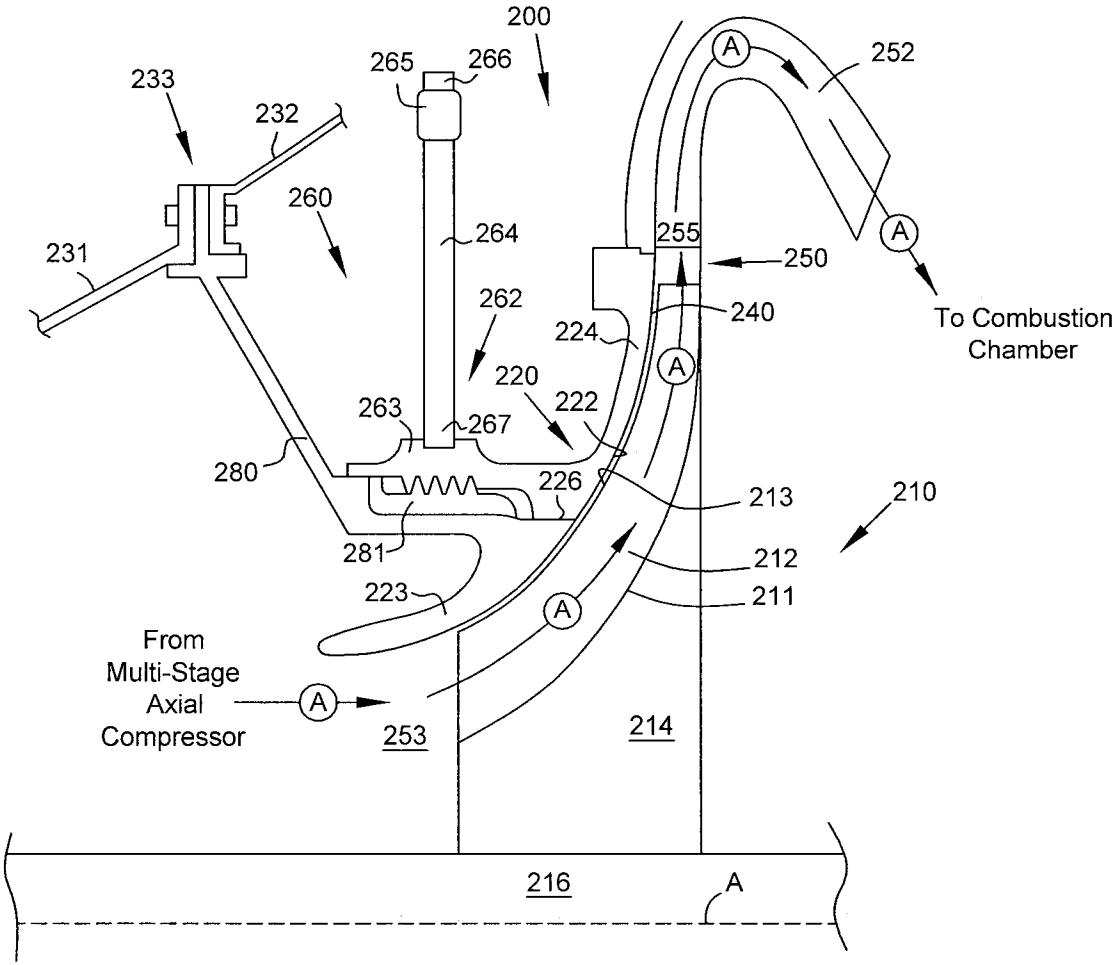
FIG. 2A is a schematic and sectional view of a centrifugal compressor system having a clearance control system with a segregated impeller shroud in accordance with some embodiments of the present disclosure.

FIG. 2A is a schematic and sectional view of a centrifugal compressor system 200 having a clearance control system 260 in accordance with some embodiments of the present disclosure. Centrifugal compressor system 200 comprises centrifugal compressor 210 and clearance control system 260.

The centrifugal compressor 210 comprises an annular impeller 211 having a plurality of centrifugal compressor blades 212 extending radially from the impeller 211. The impeller 211 is coupled to a disc rotor 214 which is in turn coupled to a shaft 216. Shaft 216 is rotatably supported by at least forward and aft shaft bearings (not shown) and may rotate at high speeds. The radially-outward surface of each of the compressor blades 212 constitutes a compressor blade tip 213.

As blade 212 rotates, it receives working fluid at an inlet pressure and ejects working fluid at a discharge pressure which is higher than the inlet pressure. Working fluid (e.g. air in a gas turbine engine) is typically discharged from a multi-stage axial compressor (not shown) prior to entering the centrifugal compressor 210. Arrows A illustrate the flow of working fluid through the centrifugal compressor 210. Working fluid enters the centrifugal compressor 210 from an axially forward position 253 at an inlet pressure. Working fluid exits the centrifugal compressor 210 at an axially aft and radially outward position 255 at a discharge pressure which is higher than inlet pressure.

Working fluid exiting the centrifugal compressor 210 passes through a diffusing region 250 and then through a deswirl cascade 252 prior to entering a combustion chamber (not shown). In the combustion chamber, the high pressure working fluid is mixed with fuel and ignited, creating combustion gases that flow through a turbine (not shown) for work extraction.

In one embodiment, the clearance control system 260 comprises at least one driving mechanism 302, 304 (see FIG. 3), at least one actuator 262, and a segregated annular impeller shroud 220. Clearance control system 260 can also be referred to as a compressor shroud assembly.

Actuator 262 comprises a threaded axial member 263 and driving member 264. Threaded axial member 263 is adapted to communicate with a threaded portion 281 of casing arm 280. In some embodiments threaded portion 281 may be carried by inducer portion 223. Driving member 264 extends along a radius of the axis of rotation A of the rotatable centrifugal compressor 210 and is coupled to an actuator ring 265. The movement of actuator ring 265 causes driving member 264 to rotate about an axis parallel to shaft 216, or the axis of rotation A of shaft 216, which in turn causes threaded axial member 263 to move in an axially forward or axially aft direction.

Shroud 220 is partly a dynamically moveable impeller shroud. Segregated annular impeller shroud 220 encases the plurality of blades 212 of the centrifugal compressor 210. Shroud 220 comprises a fixed inducer portion 223 and a moveable exducer portion 224.

In some embodiments, inducer portion 223 is formed as a unitary structure with casing arm 280; in other embodiments, inducer portion 223 is formed separate from and coupled to casing arm 280.

In some embodiments, exducer portion 224 may be formed as a unitary structure with threaded axial member 263; in other embodiments, exducer portion 224 may be formed separate from and coupled to threaded axial member 263. Exducer portion 224 further comprises a sealing surface 226 which abuts inducer portion 223. In some embodiments additional sealing components are utilized to ensure proper sealing between sealing surface 226 and inducer portion 223.

In some embodiments, surface 222 of shroud 220 comprises an abradable surface. In some embodiments, a replaceable cover is provided which covers the surface 222 and is replaced during engine maintenance due to rub of blade tips 213 against surface 222.

Clearance control system 260 is coupled to the engine casing via casing arm 280, which is joined to a first casing portion 231 and second casing portion 232 at a first mounting flange 233. In some embodiments first casing portion 231 is at least a portion of a casing around the multi-stage axial compressor.

The gap between a surface 222 of shroud 220 which faces the impeller 211 and the impeller blade tips 213 is the blade tip clearance 240. In operation, thermal, mechanical, and pressure forces act on the various components of the centrifugal compressor system 200 causing variation in the blade tip clearance 240. For most operating conditions, the blade tip clearance 240 is larger than desirable for the most efficient operation of the centrifugal compressor 210. These relatively large clearances 240 avoid rubbing between blade 212 and the surface 222 of shroud 220, but also result in high leakage rates of working fluid past the impeller 211. It is therefore desirable to control the blade tip clearance 240 over a wide range of steady state and transient operating conditions. The disclosed clearance control system 260 provides blade tip clearance 240 control by positioning shroud 220 relative to blade tips 213.

Figure 2B:
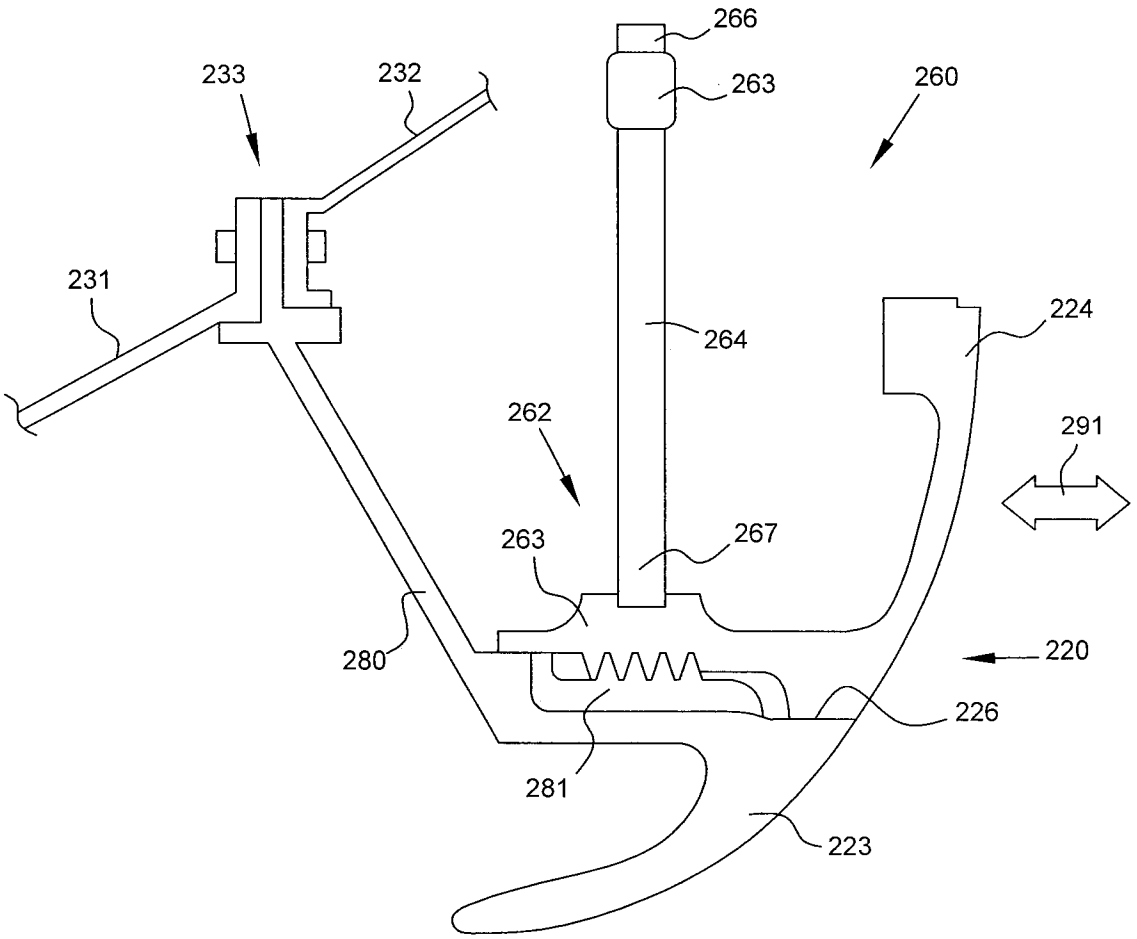
FIG. 2B is an enlarged schematic and sectional view of the clearance control system with a segregated impeller shroud illustrated in FIG. 2A, in accordance with some embodiments of the present disclosure.

FIG. 2B is an enlarged schematic and sectional view of the clearance control system 260 with segregated impeller shroud 220 illustrated in FIG. 2A, in accordance with some embodiments of the present disclosure. The operation of clearance control system 260 will be discussed with reference to FIG. 2B.

In some embodiments during operation of centrifugal compressor 210 blade tip clearance 240 is monitored by periodic or continuous measurement of the distance between surface 222 and blade tips 213 using a sensor or sensors positioned at selected points along the length of surface 222. When clearance 240 is larger than a predetermined threshold, it may be desirable to reduce the clearance 240 to prevent leakage and thus improve centrifugal compressor efficiency.

In other embodiments, engine testing may be performed to determine blade tip clearance 240 for various operating parameters and a piston chamber 274 pressure schedule is developed for different modes of operation. For example, based on clearance 240 testing, piston chamber 274 pressures may be predetermined for cold engine start-up, warm engine start-up, steady state operation, and max power operation conditions. As another example, a table may be created based on blade tip clearance 240 testing, and piston chamber 274 pressure is adjusted according to operating temperatures and pressures of the centrifugal compressor 210. Thus, based on monitoring the operating conditions of the centrifugal compressor 210 such as inlet pressure, discharge pressure, and/or working fluid temperature, a desired blade tip clearance 240 is achieved according to a predetermined schedule of pressures for piston chamber 274.

Regardless of whether clearance 240 is actively monitored or controlled via a schedule, in some operating conditions it may be desirable to reduce the clearance in order to reduce leakage past the centrifugal compressor 210. In order to reduce the clearance 240, a driving mechanism 302 (discussed below with reference to FIG. 3) imparts motion to actuator ring 265. In FIGS. 2A and 2B, the motion of actuator ring 265 is into or out of the page about an axis parallel to the axis A of shaft 216 or about the axis A of shaft 216. This motion of actuator ring 265 results in motion of driving member 264 about an axis parallel to the axis A of shaft 216 or about the axis A of shaft 216. The motion of driving member 264 is translated by threaded axial member 263 as motion in an axially forward or axially aft direction. With threaded portion 281 rigidly coupled, or "grounded", to casing 231 via casing arm 280, axial motion is transferred to the exducer portion 225 of shroud 220 as indicated by arrow 291. In some embodiments, exducer portion 225 rotates with driving member 264 as it translates axially forward or axially aft.

In some embodiments exducer portion 225 may rotate with threaded axial member 263 as it moves axially forward and aft. In other embodiments, a bearing assembly (not shown) is provided between exducer portion 225 and threaded axial member 263 such that the rotative motion of threaded axial member 263 is not transferred to exducer portion 225. The bearing assembly may be of a ball, tapered, spherical, or other type known in the art. In embodiments having bearing assemblies, the rotational motion of the driving member 264 may be translated by threaded portion 281 into axial motion of exducer portion 225 while substantially maintaining the radial alignment of the exducer portion 225.

The aft movement of exducer portion 225 caused by motion of actuator ring 265 translated through actuator 262 results in exducer portion 225 of shroud 220 moving closer to blade tips 213, thus reducing the clearance 240 and leakage. During many operating conditions this deflection of shroud 220 in the direction of blade tips 213 is desirable to reduce leakage and increase compressor efficiency.

In some embodiments one or more sensors measure the discharge pressure of centrifugal compressor 210. Actuator 262 may be activated responsive to the discharge pressure measured by the sensors, such that the exducer portion 224 is axially positioned based on the measured discharge pressure.

Where monitoring of blade tip clearance 240 indicates the need for an increase in the clearance 240, the above-described process is repeated except the actuator ring 265 is moved in the opposite direction. Shroud 220 is therefore moved axially forward, away from blade tips 213 and increasing blade tip clearance 240.

Figure 3:
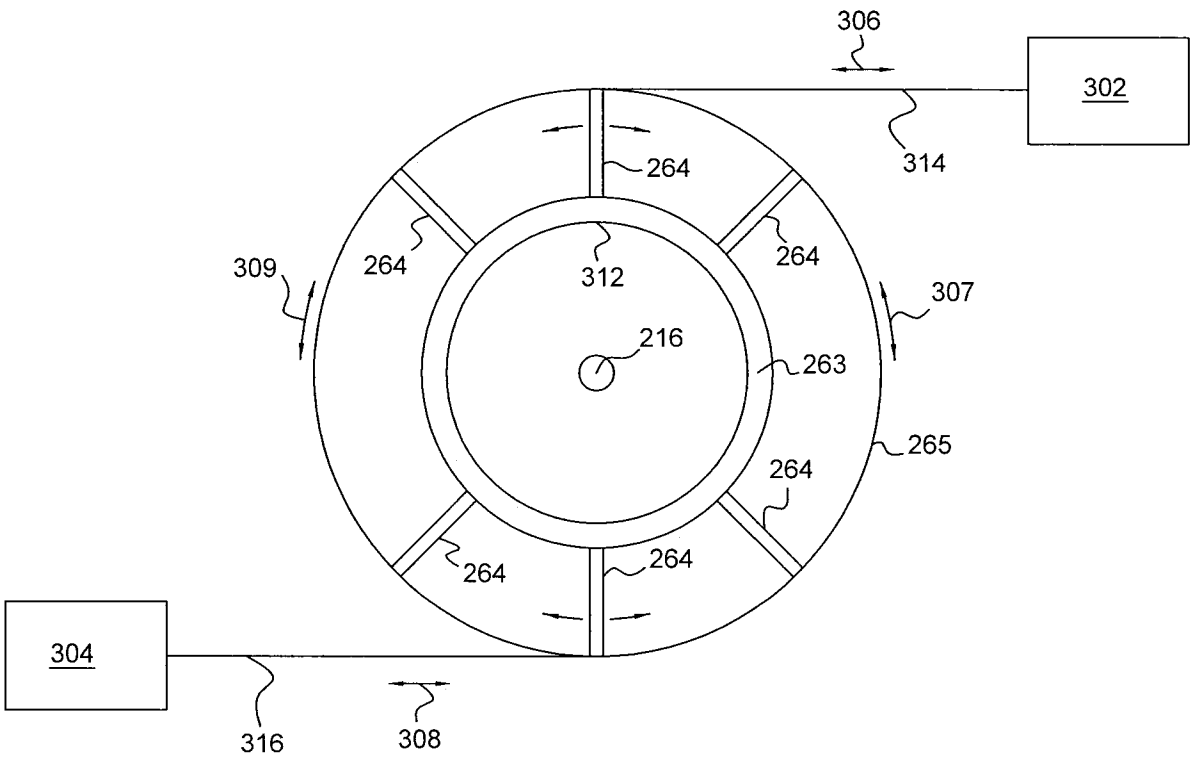
FIG. 3 is a schematic and axial view of a plurality of driver arms circumferentially disposed about a segregated impeller shroud in accordance with some embodiments of the present disclosure.

FIG. 3 is a schematic and axial view of a plurality of driving members 264 circumferentially disposed about a segregated impeller shroud 220 (not shown) in accordance with some embodiments of the present disclosure. A first driving mechanism 302 and second driving mechanism 304 are coupled via a first connector 314 and second connector 316, respectively, to actuator ring 265. Driving mechanisms 302, 304 cause motion of actuator ring 265 about an axis parallel to the axis A of shaft 216 or about the axis A of shaft 216 as indicated by arrows 307 and 309 by moving connectors 314, 316 as indicated by arrows 306, 308.

In some embodiments, more or fewer driving mechanisms are used to impart motion to actuator ring 265. For example in some embodiments each of the plurality of driving members 264 may have an individual driving mechanism. In some embodiments, first driving mechanism 302 and second driving mechanism 304 may be one of electrical, pneumatic, or hydraulic actuators.

FIG. 3 illustrates a plurality of driving arms 264 coupled to a single annular threaded axial member 263. In some embodiments, a plurality of discrete threaded axial members 263 are disposed about an annular ring 312 formed by threaded portion 281 and the axially-extending portion of casing arm 280. In some embodiments, threaded portion 281 may be a continuous annular component; in other embodiments, threaded portion 281 may be a plurality of limited, discrete components.

In the illustrated embodiment, the six driving arms 264 are coupled to a single actuator ring 265. In other embodiments, more or fewer driving arms 264 may be used. For example, in one embodiment of the present disclosure first driving mechanism 302 is coupled to a single driving arm 264 and second driving mechanism 304 is coupled to a different single driving arm 264.

In some embodiments, actuator ring 265 is divided into several portions such that a driving mechanism 302, 304 controls only a portion of the driving arms 264. For example, in some embodiments actuator ring 265 is divided in half such that first driving mechanism 302 controls half of the driving arms 264 and second driving mechanism 304 controls the other half of the driving arms 264.

Figure 4:
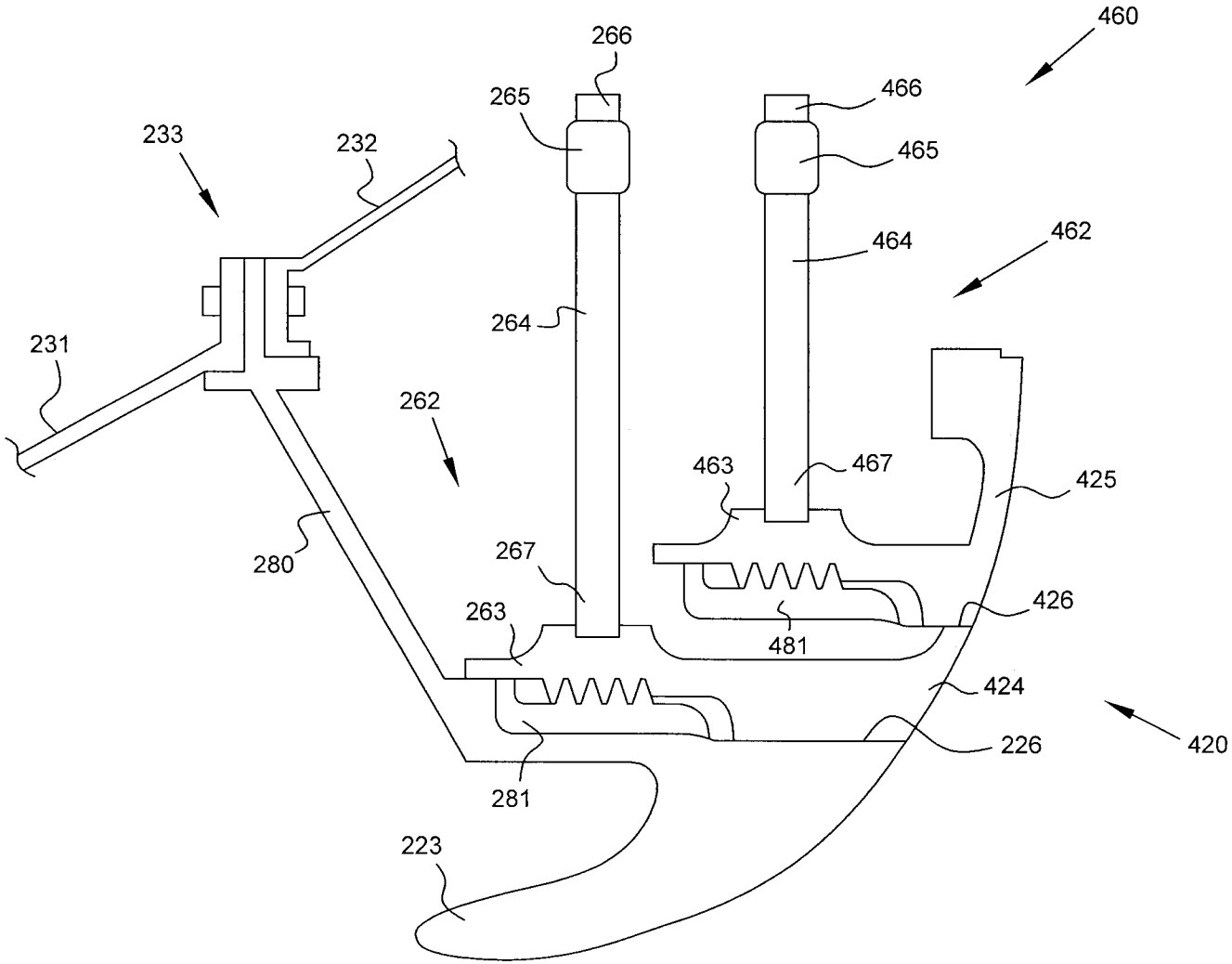
FIG. 4 is a schematic and sectional view of another embodiment of a clearance control system in accordance with the present disclosure.

FIG. 4 is a schematic and sectional view of another embodiment of a clearance control system 460 in accordance with the present disclosure. In the embodiment of FIG. 4, a first actuator 262 controls the position of a first exducer portion 424 of shroud 420, while a second driving mechanism 462 controls the position of a second exducer portion 425 of shroud 420.

First actuator 262 is substantially the same as that described above with reference to FIGS. 2A and 2B. Second driving mechanism 264 operates in a similar manner. Driving mechanism 462 comprises a threaded axial member 463 and driver arm 464. Threaded axial member 463 is adapted to communicate with a threaded portion 481. Driver arm 464 is coupled to an actuator ring 465. The movement of actuator ring 465 is translated through threaded axial member 463 as motion in an axially forward or axially aft direction.

Threaded portion 481 is coupled to casing arm 281 and thus grounded to the engine casing, via an axial arm which is not illustrated and which must be routed so as not to interfere with the motion of driving member 264. In some embodiments, driving member 264 and driver arm 464 are circumferentially staggered so as to avoid such interference.

Impeller shroud 420 comprises fixed inducer portion 223, a first exducer portion 224 coupled to first actuator 262, and a second exducer portion 225 coupled to second driving mechanism 462. Thus the clearance control system 460 provides improved clearance control at the radially outward portions of blade 212. Additional embodiments with further driving mechanisms and portions of the impeller shroud are contemplated for additional clearance control.

In some embodiments a sealed, pressurized cavity is formed proximal the forward side of exducer portion 224. The cavity may be bounded by exducer portion 224, inducer portion 223, and portions of casing 231, 232, 280. This cavity may be pressurized using an intermediate stage compressor air, inducer air, or discharge air from the centrifugal compressor 210. By pressurizing the forward side of exducer portion 224, the differential pressure across exducer portion 224 is reduced, thus reducing the amount of work required to translate exducer portion 224 axially forward and aft.

Figure 5:
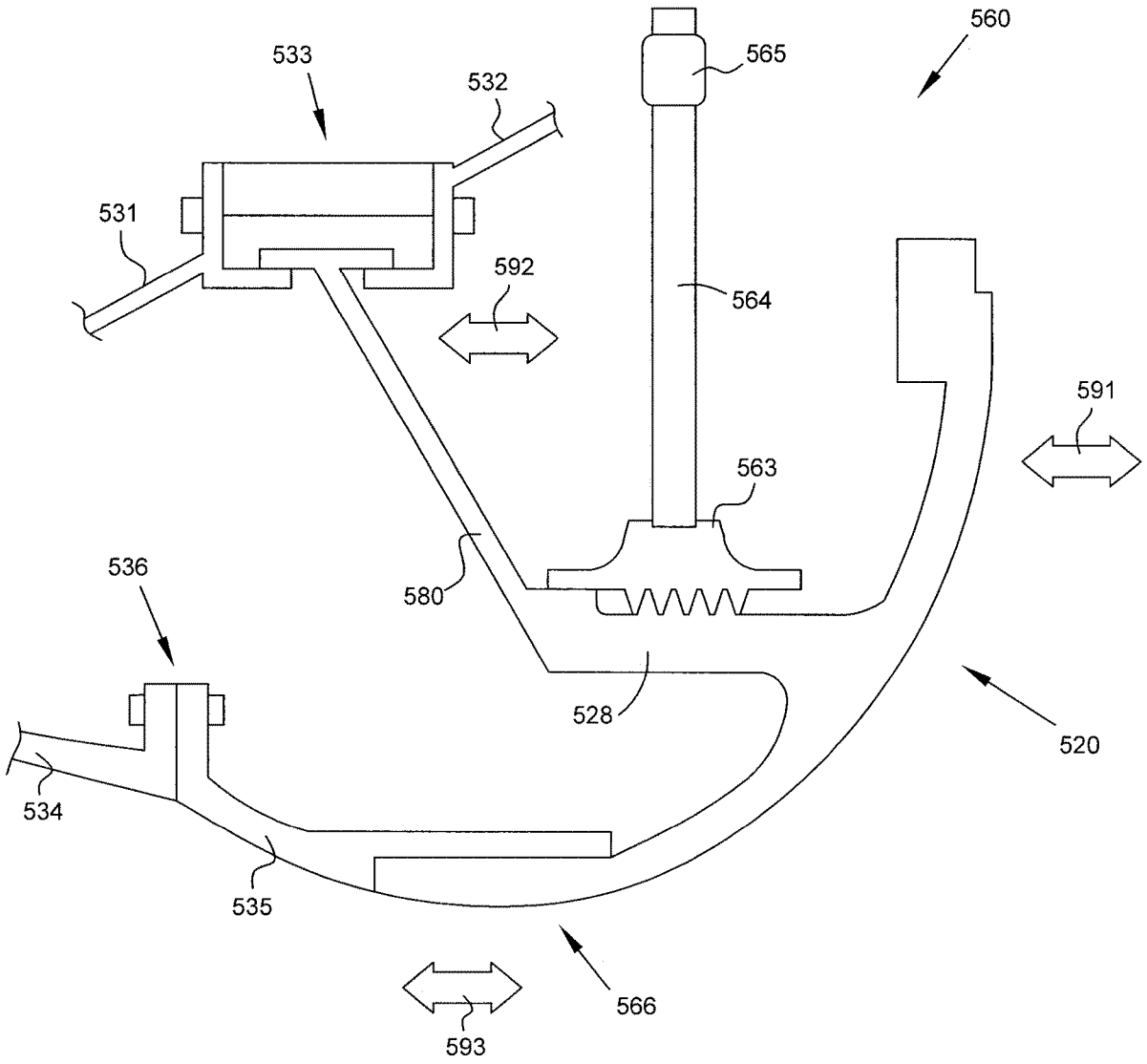
FIG. 5 is a schematic and sectional view a clearance control system in accordance with some embodiments of the present disclosure.

FIG. 5 is a schematic and sectional view of another embodiment of a clearance control system 560 in accordance with the present disclosure. Clearance control system 560 comprises a shroud 520 threadably coupled to at least one actuator 562 and slidably coupled to at least a portion of a casing 531, 532, 535. In some embodiments shroud 520 is segregated as described above with reference to FIGS. 2A and 2B, while in other embodiments shroud 520 may be a unitary or non-segregated component as illustrated in FIG. 5. Actuator 562 comprises a threaded member 563 and driving member 564 which is coupled to an actuator ring 565. Driving member 564 extends along a radius of and is rotatable about the axis of rotation of the centrifugal compressor (not shown in FIG. 5). Driving member 564 is coupled to threaded member 563 which comprises a plurality of driving threads adapted to rotate with said driving member 564 while maintaining an axial alignment. Actuator ring 565 is coupled to a driving mechanism as described above with reference to FIG. 3.

Shroud 520 is carried by various portions of the casing. Shroud 520 is threadably coupled at a threaded portion 528 to threaded member 563. Threaded portion 528 comprises a plurality of driven threads. Shroud 520 is coupled to a casing arm 280 which is slidably coupled to casing 531 and 532 at slidable junction 533. Shroud is also slidably coupled axial casing member 535 at slidable coupling 566. Axial casing member 535 is coupled at flange 536 to casing portion 534

When actuator ring 565 is moved about the axis of the impeller shaft (not shown) (i.e. into or out of the page), driving member 564 is moved about the axis of the impeller shaft as well. The motion of driving member 564 is translated by threaded member 263 as motion in an axially forward or axially aft direction. Shroud 520 moves axially forward or axially aft, with slidable coupling 566 allowing axial motion relative to axial casing member 535 and slidable junction 533 allowing axial motion relative to casing 531, 532. The motion of shroud 520 is illustrated using arrows 591, 592, and 593. In other words, the motion of driving member 564 about the axis the impeller shaft results in axial movement of shroud 520 while substantially maintaining a radial alignment.

The present disclosure provides many advantages over previous systems and methods of controlling blade tip clearances. The disclosed clearance control systems allow for tightly controlling blade tip clearances, which are a key driver of overall compressor efficiency. Improved compressor efficiency results in lower fuel consumption of the engine. Additionally, the present disclosure eliminates the use of complicated linkages, significant weight penalties, and/or significant power requirements of prior art systems.

Another advantage of the present disclosure is that by segregating the shroud, close clearance control is provided at the exducer, where blade tip clearances are predominantly in the axial direction while the shroud in the vicinity of the inducer is fixed since blade tip clearances in that region are predominantly in the radial direction.

Although examples are illustrated and described herein, embodiments are nevertheless not limited to the details shown, since various modifications and structural changes may be made therein by those of ordinary skill within the scope and range of equivalents of the claims.

What is claimed is:

1. A compressor shroud assembly comprising:

a static compressor casing;

an actuator carried by said casing, said actuator comprising a driving member extending along a radius of the axis of rotation of a rotatable centrifugal impeller and being rotatable about said axis; and an impeller shroud for encasing the rotatable centrifugal impeller, the impeller shroud coupled at a forward end to said casing by a slidable coupling that maintains an air boundary during the full range of axial movement of said impeller shroud, said shroud being threadably coupled to said driving member so that rotation of said driving member about the axis of rotation effects translation of at least a portion of said shroud relative to the rotatable centrifugal impeller.

2. The compressor shroud assembly of claim 1 wherein the translation of at least a portion of said shroud relative to the rotatable centrifugal impeller is in an axial direction while maintaining a radial alignment of said portion of said shroud.

3. The compressor shroud assembly of claim 1 wherein said actuator further comprises a driving mechanism coupled to said driving member to rotate said driving member about the axis of rotation when said actuator is actuated.

4. The compressor shroud assembly of claim 1 wherein said threaded coupling between said driving member and said shroud comprises driving threads which rotate with said driving member while maintaining an axial alignment, and driven threads which translate axially with said portion of said shroud.

5. The compressor shroud assembly of claim 4 wherein said actuator comprises two or more driving members spaced around the axis of rotation of said driving members.

6. The compressor shroud assembly of claim 5 further comprising an actuating ring coupled to each of said driving members and to said driving mechanism.

7. The compressor shroud assembly of claim 1 further comprising one or more sensors for measuring the clearance gap between said axially translatable portion of said shroud and the rotatable centrifugal impeller, said actuator being actuated in response to the clearance gap measured by the one or more sensors.

8. The compressor shroud assembly of claim 1 further comprising one or more sensors for measuring discharge pressure of the rotatable centrifugal impeller, said actuator being actuated in response to the measured pressure.

9. A compressor section in a gas turbine engine, said compressor section comprising:

a static casing;

a rotatable centrifugal impeller; and a compressor shroud assembly comprising:

an actuator carried by said casing, said actuator comprising a driving member extending along a radius of the axis of rotation of the rotatable centrifugal impeller and being rotatable about the axis; and an impeller shroud for encasing said rotatable centrifugal impeller, said shroud comprising a static inducer portion statically coupled to said casing and an axially translatable exducer portion threadably coupled to said inducer portion and statically coupled to said driving member, the threaded coupling between said inducer portion and said exducer portion comprising static threads which maintain an axial alignment and moveable threads which rotate and axially translate with said driving member and said exducer portion to effect translation of said exducer portion relative to the rotatable centrifugal impeller in an axial direction.

10. The compressor section of claim 9 wherein said exducer portion comprises a first exducer portion threadably coupled to a second exducer portion, each of said exducer portions being independently axially translatable.

11. The compressor section of claim 10 wherein said first exducer portion is coupled to a first actuator and said second exducer portion is coupled to a second actuator.

12. The compressor section of claim 11 wherein said first actuator comprises said driving member and a driving mechanism coupled to said driving member to rotate said driving member about the axis of rotation when said actuator is actuated.

13. The compressor section of claim 11 wherein said second actuator comprises said driving member and a driving mechanism coupled to said driving member to rotate said driving member about the axis of rotation when said actuator is actuated.

14. The compressor section of claim 12 wherein said actuator comprises two or more driving members spaced around the axis of rotation of said driving members.

15. The compressor section of claim 14 further comprising an actuating ring coupled to each of said driving members and to said driving mechanism.

16. A compressor shroud assembly comprising:

a static compressor casing;

an impeller shroud for encasing a rotatable centrifugal impeller, said shroud comprising:

an inducer portion mounted to said casing;

a first exducer portion coupled to said inducer portion; and a second exducer portion threadably coupled to said first exducer portion, wherein each of said first and second exducer portions is independently translatable relative to the rotatable centrifugal impeller in an axial direction while maintaining a radial alignment; and an actuator carried by said casing, wherein said actuator is operable to rotate about the axis of the centrifugal impeller to effect translation of one or both of said first exducer portion and said second exducer portion.

17. The compressor assembly of claim 16 wherein said actuator comprises a driving member extending along a radius of the axis of rotation of the rotatable centrifugal impeller and being rotatable about the axis.

18. The compressor assembly of claim 16 further comprising a threaded coupling between said inducer portion and said first exducer portion wherein relative rotation about the axis of the centrifugal impeller between said inducer portion and said first exducer portion effects axial translation of said first exducer portion.

19. The compressor assembly of claim 16 further comprising a threaded coupling between said first exducer portion and said actuator, wherein relative rotation about the axis of the centrifugal impeller between said first exducer portion and said actuator effects axial translation of said first exducer portion.

* * * * *